US007997112B2

(12) United States Patent
Sandman et al.

(10) Patent No.: US 7,997,112 B2
(45) **Date of Patent: *Aug. 16, 2011**

(54) FLANGE-FORMING SYSTEM FOR TUBE AND RELATED METHODS

(75) Inventors: Joseph P. Sandman, Morrow, OH (US); Michael N. Sandman, Morrow, OH (US)

(73) Assignee: Langdon Incorporated, Cincinnati, OH (US)

( * ) Notice: Subject to any disclaimer, the term of this patent is extended or adjusted under 35 U.S.C. 154(b) by 492 days.

This patent is subject to a terminal disclaimer.

(21) Appl. No.: 11/862,472

(22) Filed: Sep. 27, 2007

(65) Prior Publication Data

US 2009/0085347 A1 Apr. 2, 2009

(51) Int. Cl.
*B21D 19/00* (2006.01)

(52) U.S. Cl. ..... 72/105; 72/106; 72/125; 72/370.11; 72/460

(58) Field of Classification Search ..... 72/105, 72/106, 120, 121, 409.19, 460, 458, 459, 72/479, 212, 211, 49, 50, 220, 370.1, 370.11, 72/409.18, 101, 125, 213, 214
See application file for complete search history.

(56) References Cited

U.S. PATENT DOCUMENTS

| | | | | |
|---|---|---|---|---|
| 1,298,656 | A | 4/1919 | Brinkman | |
| 1,304,939 | A | 5/1919 | Brinkman | |
| 2,611,413 | A | 9/1952 | Molinare | |
| 2,840,136 | A | 6/1958 | Bellarts | |
| 2,940,502 | A * | 6/1960 | La Martine | 72/105 |
| 3,762,204 | A | 10/1973 | Socier | |
| 3,765,351 | A * | 10/1973 | Kubacki et al. | 72/105 |
| 4,008,592 | A | 2/1977 | Hall et al. | |
| 4,070,886 | A | 1/1978 | Nyssen | |
| 4,369,911 | A | 1/1983 | Blumenberg | |
| 4,590,785 | A | 5/1986 | Morris | |
| 4,715,581 | A | 12/1987 | Myers | |
| 5,014,424 | A | 5/1991 | Takasugi | |
| 5,355,722 | A | 10/1994 | Socier | |
| 5,983,496 | A | 11/1999 | Hermanson | |
| 6,935,153 | B2 | 8/2005 | Frigo et al. | |
| 7,121,129 | B2 | 10/2006 | Binggeli | |
| 7,257,975 | B1 * | 8/2007 | Stauffacher et al. | 72/117 |
| 2002/0100304 | A1 | 8/2002 | Price et al. | |
| 2002/0153725 | A1 | 10/2002 | Myers | |

OTHER PUBLICATIONS

Spinfinity, Inc., AccuFlange TM [online], 2006 [retrieved on Jun. 30, 2008], retrieved from the Internet: <URL: http://www.spinfinity.net/accuflange/index.html>, 3 pages.

Eastern Sheet Metal, L.L.C., Spiral Pipe & Fittings, Connectors [online], Jun. 2005 [retrieved on Jun. 30, 2008], retrieved from the Internet: <URL: http://www.easternsheetmetal.com/mainpages/productguides/productguides/Connectors.pdf>, 4 pages.

(Continued)

*Primary Examiner* — Debra M Sullivan

(74) *Attorney, Agent, or Firm* — Wood, Herron & Evans, LLP

(57) ABSTRACT

A system is configured for forming a flange at an end of a tube. The system includes a collar configured to receive the tube. A first roller engages the collar and a second roller is configured to cooperate with the first roller to rotate the collar and the tube. A rotatable cam is disposed about the second roller and includes a cam surface configured to bend the end of the tube to thereby form the flange. The collar may be configured to restrict axial movement of the tube relative to the collar. Additionally or alternatively, the collar may be configured to restrict rotational movement of the tube relative to the collar.

24 Claims, 16 Drawing Sheets

OTHER PUBLICATIONS

Nordfab, Technical Manual 2011, Quick-Fit Clamp-Together Ducting, The World's Fastest Ducting, Thomasville, NC, www.nordfab.com, ID: 030111 (44 pages).

Nordfab, New and Improved Quick-Seal Clamps [on-line], Nordfab Ducting 2011 [retrieved on Mar. 17, 2011], retrieved from the Internet: <URL: http://www.nordfab.com/index.cfm/do/pages.view/id/124/page/Quick-Seal-Clamps>, 1 page.

Kirk & Blum, Duct and Components for Industrial Air Systems, CECO Environmental, Greensboro, NC, Jul. 2010, 45 pages.

Sheet Metal Connectors, Inc., E-Z Flange Jr. Spiral Pipe System [online], 2011, [retrieved on Mar. 17, 2011], retrieved from the Internet: <URL: http://www.smcduct.com/e-z-flange-spiral-pipe-system/e-z-flange-jr-spiral-pipe-system>, 2 pages.

* cited by examiner

FLANGE-FORMING SYSTEM FOR TUBE AND RELATED METHODS

FIELD OF THE INVENTION

The present invention relates generally to devices for forming tubes and, more particularly, to devices for forming a flange at an end of a metal tube such as ductwork.

BACKGROUND OF THE INVENTION

Metal tubes are used in different applications. For example, hollow tubes are used in heating, ventilation, air conditioning or dust collection systems, such that processed air (e.g., heated, cooled, or return air) or particle-carrying air streams can be directed through an interior of the ducts to different locations within a building.

For example, ventilation ductwork may include two or more ducts connected in series, such as to facilitate distribution and/or directing of air. To this end, the ducts may be manufactured to include a flange at one or both of the ends of the ducts. Confronting flanges from two ducts are then fastened together to secure a connection between the ducts.

Formation of a flange at an end of a duct is often done after the duct has been formed and may require complex equipment and/or processes to form the flange. It may, for example, require complex hydraulic systems which may require high degrees of maintenance.

Conventional processes for forming a flange may include manually hammering an end of the tube against an anvil to thereby form the flange. Other conventional processes include manually supporting and tilting the tube against rotating rollers. The manual nature of these known processes may be unreliable and/or complex, and may result in flanges of inconsistent quality.

In the case of spiral tubes, an added challenge arises from the presence of a seam formed in the wall of the spiral tubes. The seam interferes with conventional processes to thereby produce a distorted flange or one of inconsistent quality.

Consequently, there is a need for a device and related methods for forming a flange at an end of a tube in a consistent manner and which addresses these and other drawbacks.

SUMMARY OF THE INVENTION

The various embodiments of this invention offer advantages over known systems and processes for forming a flange at an end of a tube. In one embodiment, a system is configured for forming a flange at an end of a tube. The system includes a collar configured to receive the tube and which may be configured to restrict axial and/or rotational movement of the tube relative to the collar. In this regard, the collar may include a channel configured to receive a seam of the tube, such as a helically directed seam oriented at an acute angle relative to the tube. A first roller engages the collar and a second roller is configured to cooperate with the first roller to rotate the collar and tube. A motor may be operatively coupled to at least one of the first and second rollers and be configured to rotate at least one of the first and second rollers and be configured to rotate the collar. A rotatable cam is disposed about the second roller and includes a cam surface configured to bend the end of the tube to thereby form the flange.

In one embodiment, the collar and the first roller respectively include first and second lips cooperating with one another to restrict axial movement of the collar relative to the first roller. The rotatable cam may include an axis such that the cam surface extends in a circumferential direction about the axis. In one embodiment, moreover, the cam surface is oriented on a plane that defines an acute angle relative to the axis. In this regard, rotation of the rotatable cam about the axis may advance the cam surface toward the end of the tube to thereby form the flange. In one aspect, the rotatable cam may be rotatable relative to the second roller about the axis. In order to facilitate rotation of the rotatable cam, a handle may be coupled to the cam.

In another embodiment, the system includes a second rotatable cam. In this specific embodiment, the cam surface is configured to bend the end of the tube in a first direction. The second rotatable cam includes a second cam surface that is configured to bend a distal portion at the end of the tube in a second direction that is transverse to the first direction.

In yet another embodiment, the collar includes at least two shells that are hingedly coupled. The shells are configured to substantially conform to an outer surface of the tube. Moreover, the collar may have a clamp to move the shells into locking engagement with the tube.

In another embodiment, a system is configured for forming a flange at an end of a spiral tube having a helically directed seam disposed on a wall of the spiral tube. The system includes a collar configured to conform to the wall and which includes an end portion configured to receive a distal portion of the helically directed seam, with the distal portion partially defining the flange. The collar may also include a channel configured to receive a main portion of the helically directed seam. A first roller engages the collar while a second roller is configured to cooperate with the first roller to rotate the collar and the spiral tube. A rotatable cam is disposed about the second roller and includes a cam surface configured to bend the end of the spiral tube to thereby form the flange.

In yet another embodiment, a system is configured for forming a flange at an end of a tube but includes no collar at all. In such system, a first roller is configured to engage the tube, while a second roller is configured to cooperate with the first roller to rotate the tube. A rotatable cam is disposed about the second roller and includes a cam surface that is configured to bend the end of the tube to thereby form the flange. Like other embodiments of the invention, the system may also include a second rotatable cam configured to bend the end of the tube in a direction transverse to that caused by the first rotatable cam.

In an alternative embodiment, a rotatable cam for bending an end of a sheet of metal includes a main axis and an outer perimeter disposed about the axis. A cam surface is configured to engage the end of the sheet of metal. The cam surface extends circumferentially and axially between first and second edges that are transverse to one another.

According to another embodiment, a juncture assembly between first and second tubes includes first and second flanges formed at the ends of the tubes. The flanges include respective legs in a confronting relationship and defining a gap between them. A gasket member contacts the flanges and is configured to prevent travel of fluids through the gap.

In yet another embodiment, a method of forming a flange at an end of a tube includes engaging the tube with a collar surrounding an outer surface of the tube. The collar is engaged with a pair of rollers cooperating with one another to rotate the collar and the tube. The flange is formed by rotating a cam and advancing a cam surface of the cam against the end of the tube, with the resulting flange being oriented in a first direction. A second cam may be advanced against a distal portion of the end of the tube to bend the distal portion in a second direction transverse to the first direction.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
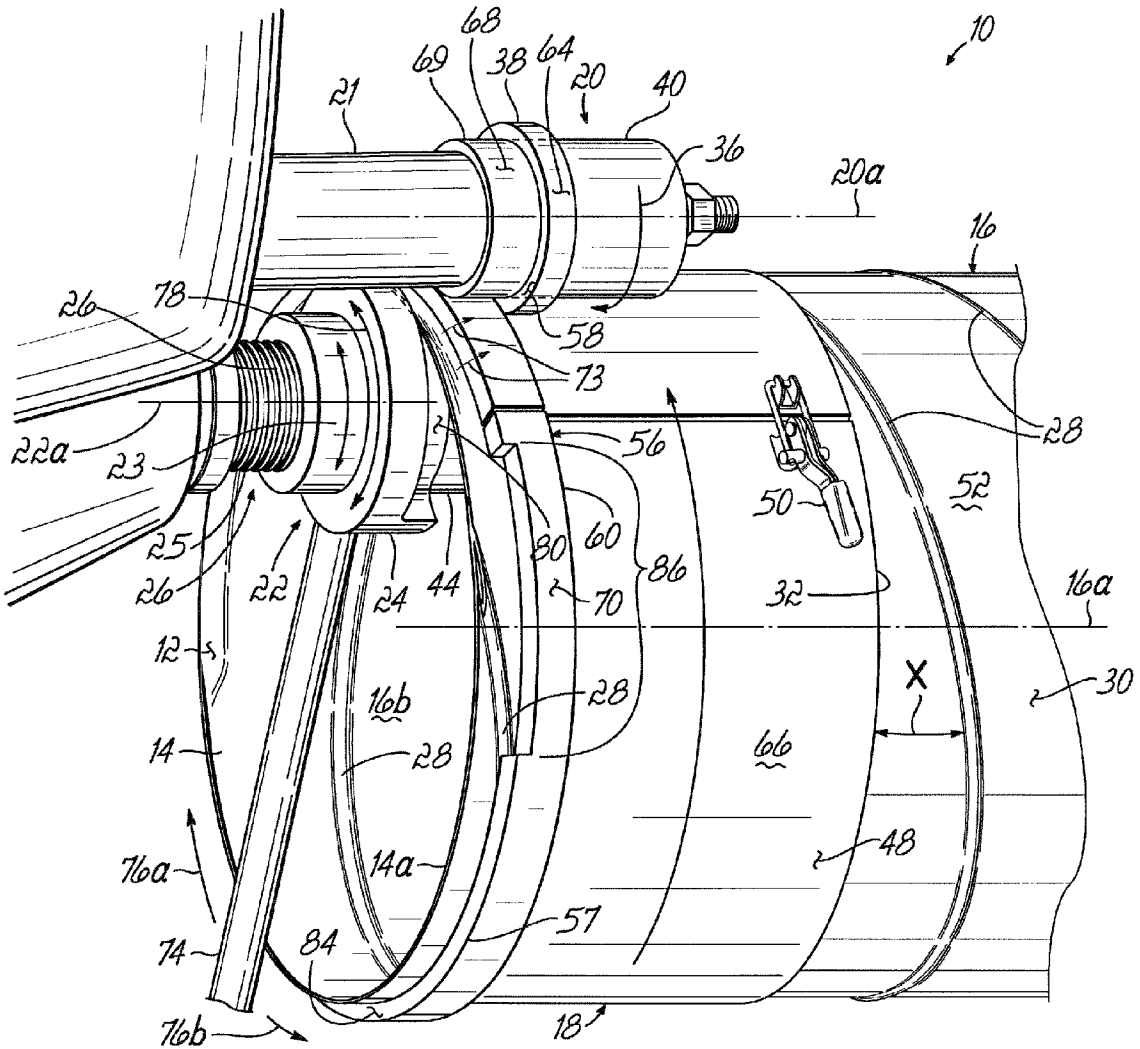
FIG. 1 is a perspective view of a flange-forming system according to one embodiment of the present invention.
Figure 2:
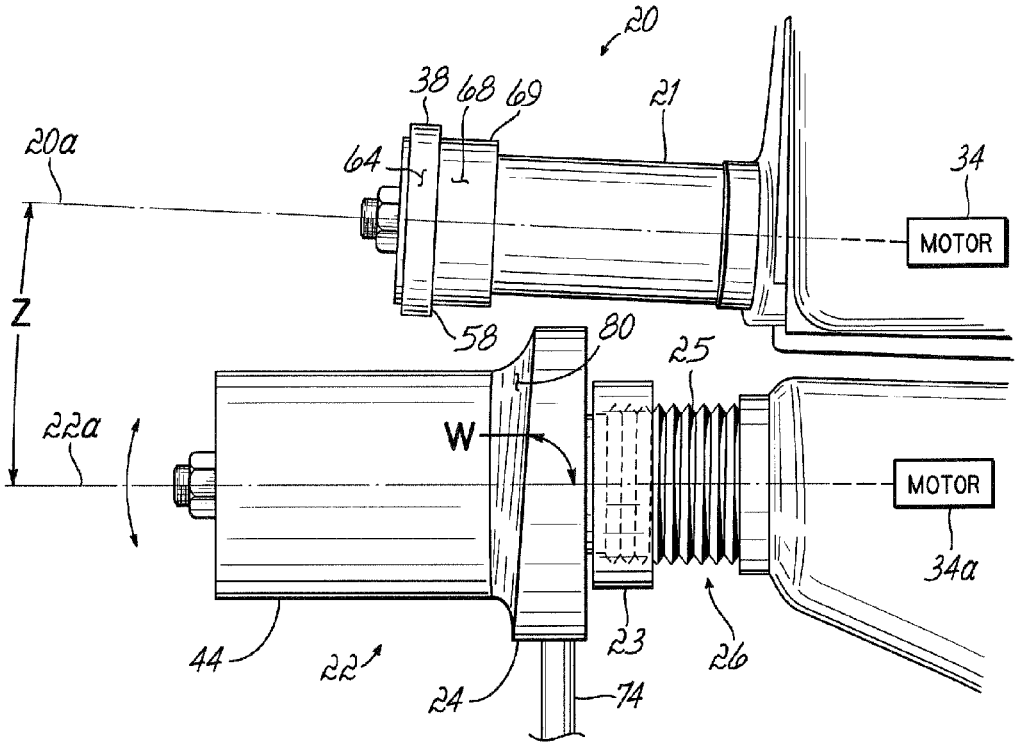
FIG. 2 is a perspective view of a pair of rollers and a rotatable cam of the system of FIG. 1.

With reference to the figures and, more particularly to FIGS. 1-2, a system 10 is shown for forming a flange 12 at an end 14 of a tube 16, such as a ventilation duct, by way of example, formed from a sheet of metal. The system 10 includes a collar 18 that engages the tube 16, as well as a pair of rollers 20, 22, and a rotatable cam 24. The collar 18 cooperates with the rollers 20, 22, as explained in further detail below, to enable formation of the flange 12. More specifically, the rollers 20, 22 and collar 18 cooperate with one another to restrict and rotate the tube 16 such the rotatable cam 24 can engage end 14 to thereby form the flange 12.

In the exemplary embodiment of FIG. 1, the tube 16 is shown having a helically-directed seam 28 extending on a wall 30 of the tube 16, although other types of tubes are contemplated. In the view depicted in FIG. 1, and when the tube is engaged by the collar 18, the seam 28 defines an acute angle "X" with a first end 32 of the collar 18.

As described above, the system 10 includes a pair of rollers 20, 22. The first roller 20 extends along and rotates about an axis 20*a*. The first roller may further be driven by a motor 34 operatively coupled to first roller 20 in ways well known to those of ordinary skill in the art. Motor 34, which is diagrammatically depicted in FIG. 2, accordingly rotates the first roller 20, for example, in the direction indicated by arrow 36. The first roller 20 moreover includes a shaft 21 and a lip 38 radially protruding from a main body portion 40 of the lip 38. As explained in further detail below, the lip 38 enables engagement of first roller 20 with collar 18.

With further reference to FIGS. 1-2, the second roller 22 includes a shaft 26 and is rotatable about an axis 22*a* defined by second roller 22. Accordingly, the second roller 22 may be rotatable, for example, clockwise, counter-clockwise, or both, as indicated by the double-headed arrow drawn thereon. In one aspect of this embodiment, the second roller 22 is rotatable at least in a direction opposite that of first roller 20, as explained below, to enable rotation of the collar 18 and tube 16.

When the first and second rollers 20, 22 engage the collar 18, the first and second rollers 20, 22 may further be approximately parallel to one another, as shown in FIG. 1. More specifically, orientation of the axes 20*a*, 22*a* may define a relatively small angle between them when rollers 20, 22 engage the collar 18. In order to receive the collar 18 between rollers 20, 22, the first roller 20 is movable to an open position relative to the second roller 22 (FIG. 2) where an acute angle "Z" is defined between axes 20*a*, 22*a*. Alternatively, the second roller 22 may be movable relative to a fixed first roller 20 or both rollers 20, 22 may be movable relative to one another.

With further reference to FIGS. 1-2, when the first and second rollers 20, 22 engage the collar 18, the second roller 22 supports the tube 16 being held by the collar 18. More particularly, a distal portion 44 of the shaft 26 contacts an interior surface 16*b* of the tube 16, thereby supporting at least a portion of the tube 16 thereon.

The configurations of the first roller 20 and collar 18 facilitate locking engagement and restriction tube 16 from relative movement, to enable forming of the flange 12. More particularly, the collar 18 lockingly engages the tube 16 to at least restrict rotational and axial movement (i.e., respectively about and along axis 16*a*) of the tube 16 relative to the collar 18. To this end, collar 18 substantially conforms to an outer surface 52 of the tube 16 and further includes a clamp 50 that lockingly engages the collar 18 against outer surface 52. More specifically, collar 18 includes a channel 46 (FIG. 4) disposed on an inner surface of a wall 48 defining the collar 18. The channel 46 has a helically-directed shape substantially matching the shape of the seam 28 of the tube 16. Accordingly, the channel 46 receives at least a portion of the seam 28 therein to restrict movement of the tube 16 relative to the collar 18. Similarly, the clamp 50 frictionally engages the wall 48 of the collar 18 with the outer surface 52 to further restrict movement of the tube 16 relative to collar 18.

Moreover, first roller 20 restricts the collar 18 from movement relative to the first roller 20, thereby further restricting tube 16 from relative movement. More particularly, a lip 56 positioned at a second end 57 of the collar 18 cooperates with the lip 38 of the first roller 20 to restrict movement of the collar 18. Specifically, as shown in FIG. 1, an end face 58 of the first roller 20 engages an oppositely oriented end face 60 of the lip 56, such that relative movement of the collar 18 and tube 16 is restricted as described above. Accordingly, the axial position (along axis 16*a*) of end 14 of tube 16 is relatively fixed, which facilitates forming of the flange 12 as explained in more detail below.

FIGS. 1-4 best describe the operation of system 10 in the formation of the flange 12. The system 10 rotates the tube 16 generally about the axis 16*a* thereof to facilitate forming of the flange by engagement of rotatable cam 24. Rotation of tube 16 is facilitated by engagement of first roller 20 with confronting portions of the collar 18. More particularly, lip 38 of first roller 20 includes a circumferentially directed surface 64 that contacts and frictionally engages an outer surface 66 of the wall 48 of collar 18. Rotation of first roller 20 rotates the collar 18, which, in turn, rotates tube 16. Moreover, a circumferentially directed surface 68 of a proximal portion 69 of first roller 20 may cooperate with surface 64 to further facilitate rotation of collar 18. More particularly, the surface 68 may contact and frictionally engage, for example, a rim surface 70 of the lip 56 to facilitate such rotation.

Second roller 22 cooperates with first roller 20 to rotate collar 18 and tube 16. As described above, the distal portion 44 of second roller 22 supports the tube 16 by contacting the interior surface 16*b* of the tube 16. When the first and second rollers 20, 22 engage the collar 18 (as shown in FIG. 1), the lip 38 and distal portion 44 cooperatively nip the collar 18 and tube 16. The resulting nipped engagement facilitates rotation of the tube 16 and collar 18 as rollers 20, 22 rotate. To this end, the second roller 22 may be suitably motorized, via motor 34*a* (FIG. 2), such that rotation of the distal portion 44 effectively matches (though in opposite directions) a surface speed of the lip 38. Alternatively, the second roller 22 may be made to follow the surface speed of the interior surface 16*b*, which is induced by motorized rotation of first roller 20.

With further reference to FIGS. 1-4, rotation of the tube 16 enables formation of the flange 12 by engagement of the rotatable cam 24 with end 14 of tube 16. More particularly, such engagement bends the end 14 in a direction generally indicated by arrows 73 (FIG. 1). Rotatable cam 24 is disposed about second roller 22 and is rotatable, about axis 22*a*, relative to second roller 22. Moreover, the position of rotatable cam 24 along axis 22*a* is determined by the position of an adjustment collar 23 threadably engaged with a threaded portion 25 of second roller 22. In this regard, adjustment collar 23 prevents movement of the rotatable cam 24 away from the tube 16. Rotation of rotatable cam 24 advances a cam surface 80 of rotatable cam 24 against end 14 to form flange 12. To this end, cam surface 80 extends circumferentially about axis 22*a* of second roller 22 and is oriented on a plane defining an acute angle "W" relative to axis 22*a*. The rotatable cam is explained in further detail below, with reference to FIGS. 8-11.

In one aspect of the embodiment depicted in FIGS. 1-4, the length (i.e., radial dimension) of the resulting flange 12 is determined by a position of an end face 84, at second end 57 of collar 18, relative to an end edge 14*a* of tube 16. More specifically, the end face 84 provides a limiting surface against which cam surface 80 is restricted from advancing along axis 22*a* when rotatable cam 24 is rotated. Accordingly, a user may be able to control the length of the resulting flange 12 by choosing the length of tube 16 that extends beyond the second end 57.

Rotation of rotatable cam 24 is facilitated by suitably chosen components. In this exemplary embodiment, and by way of example, rotatable cam 24 is manually rotatable by suitable motion of a handle 74 coupled to rotatable cam 24. Handle 74 is in the form of a generally elongate element oriented transverse to the axis 22*a*. Accordingly, rotation of handle 74 in the general directions of arrows 76*a*, 76*b* cause a corresponding rotation of rotatable cam 24 in the general direction of arrow 78, which engages tube 16 to form flange 12. Those of ordinary skill in the art will readily appreciate other types of handles or the like that can be alternatively used to rotate rotatable cam 24. Moreover, rotatable cam 24 may alternatively be motorized or otherwise have other non-manual types of actuation.

Figure 3:
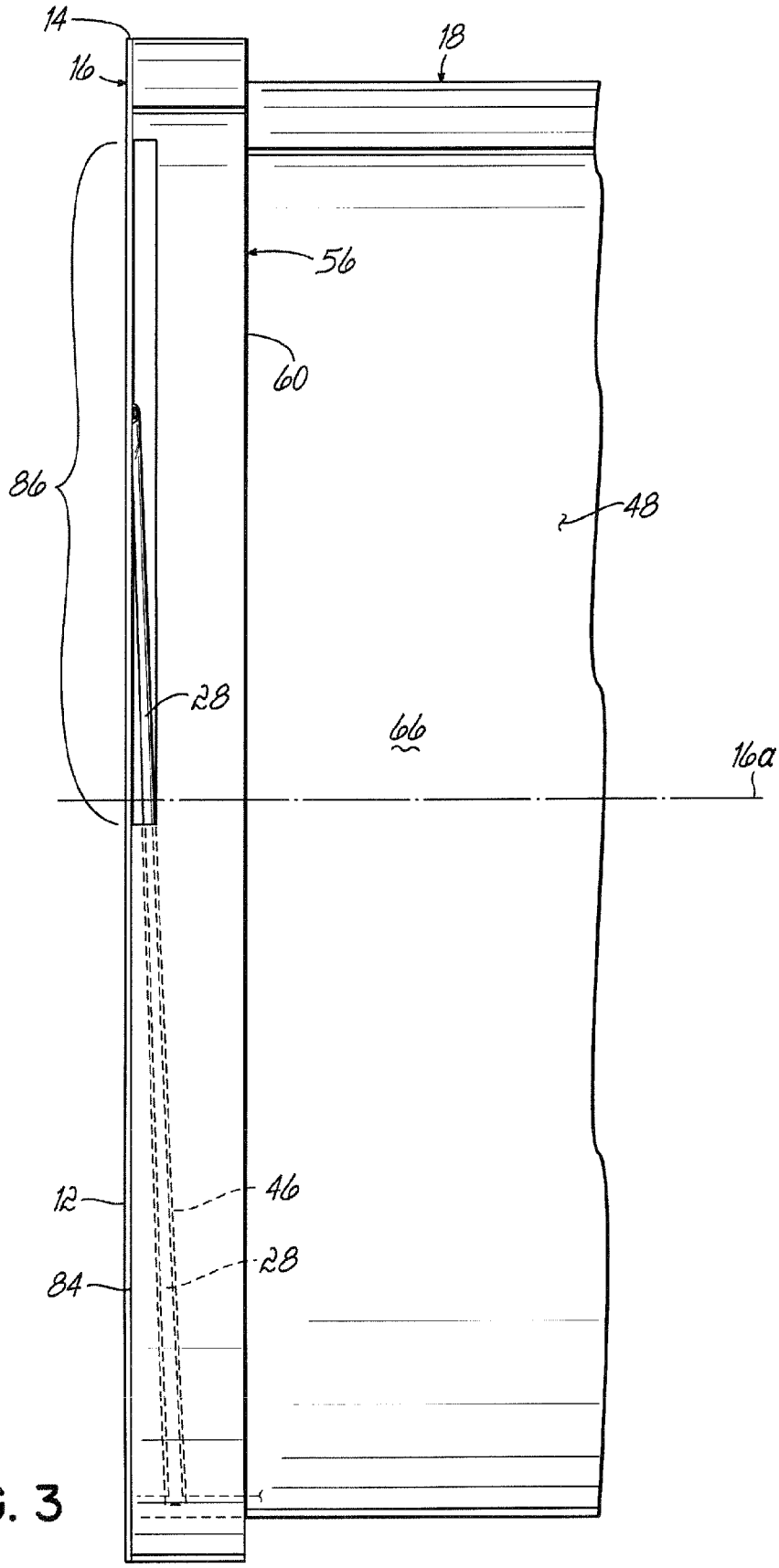
FIG. 3 is an elevational view of a groove of a collar of the system of FIG. 1, showing a portion of a seam of a tube therein.

With particular reference to FIG. 3, collar 18 is configured to facilitate formation of flange 12 in the presence of seam 28. More particularly, lip 56 of collar 18 includes a groove 86 that extends along a portion of the lip 56. The groove 86 is configured to receive the seam 28 as the flange 12 is being formed. As the end 14 of tube 16 is bent in the direction indicated by arrows 73 (FIG. 1), the portion of seam 28 that protrudes beyond the end face 84 is received within the groove 86. To this end, the length (the circumferential dimension along lip 56) and depth (i.e., the direction along axis 16*a*) of the groove 86 are suitably chosen to accommodate the portion of seam 28 extending beyond end face 84.

Figure 4:
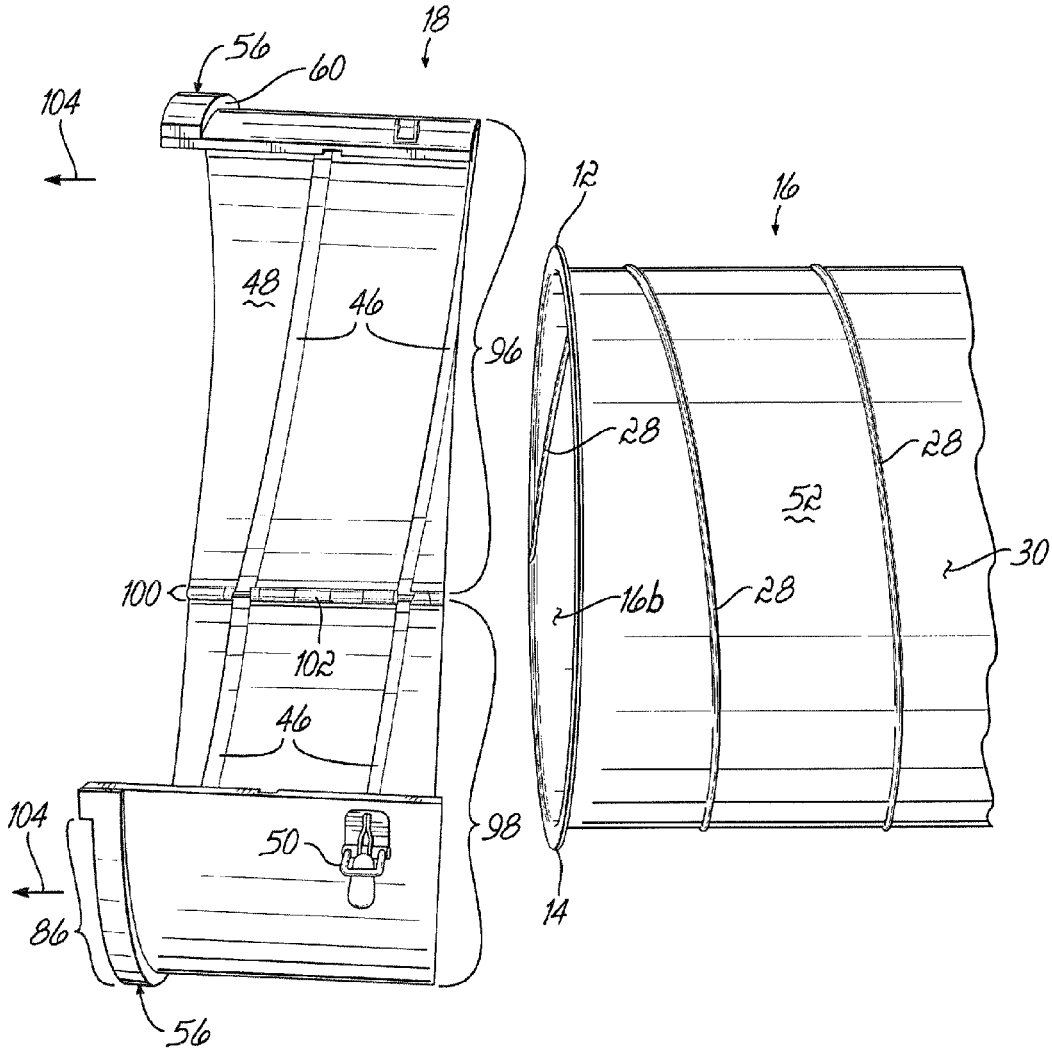
FIG. 4 is a perspective view of a collar and tube of FIG. 1, illustrating the collar disassembled from the tube.

With particular reference to FIG. 4, the collar 18 may be disengaged and separated from tube 16 (in the general direction of arrow 104) after formation of the flange 12. To this end, the collar 18 includes two shells 96, 98 coupled along a juncture 100 that facilitate engagement and disengagement of collar 18 from tube 16. Coupling between shells 96, 98 is suitably chosen and may include conventional hinges 102 of types well known in the art. Engagement and disengagement are further facilitated by clamp 50, which selectively moves the two shells 96, 98 into locking engagement with outer surface 52 of the tube 16.

Those of ordinary skill in the art will readily appreciate that other types of collars may be used in combination with the other components of the system 10 herein described. For example, and without limitation, an alternative collar may have more than two shells or even include a single shell, so long as the collar includes features to restrict movement of the tube 16 relative to the collar. Similarly, a collar may take on a different form. For example, and with reference to the embodiment of FIG. 4A, an alternative embodiment of a flange-forming system includes a collar 99 that is different from the collar 18 of the embodiment of FIGS. 1-4. For ease of understanding, like reference numerals in FIG. 4A refer to like features in FIGS. 1-4. Collar 99 is similar in structure and function to lip 56 of collar 18, including, for example, a groove 86*a*, having a function similar to that of groove 86 of FIG. 1. In this regard, the description of lip portion 56 may be referred-to for an understanding of collar 99 as well.

Figure 4A:
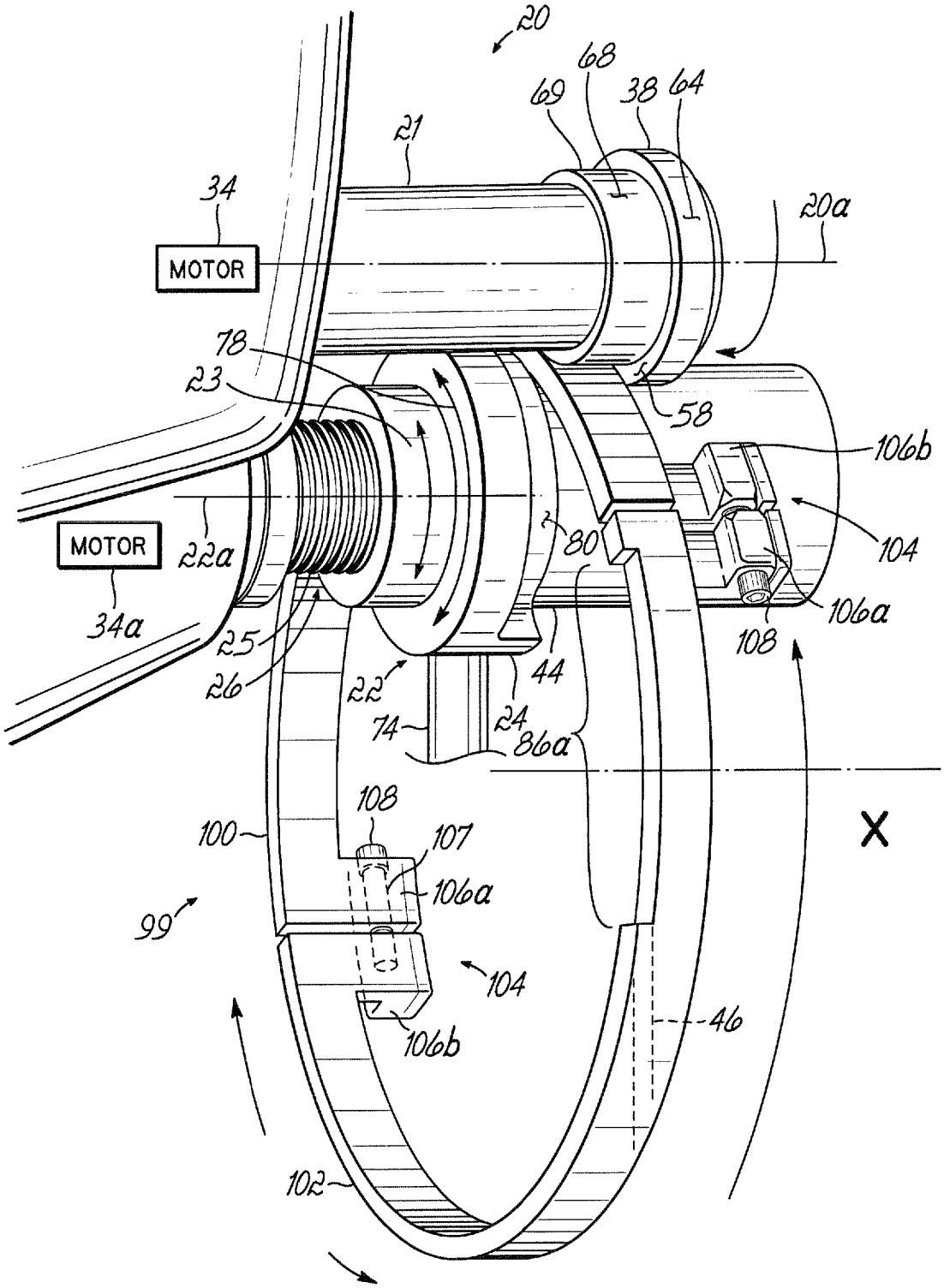
FIG. 4A is a perspective view of a flange-forming system including an alternative collar in accordance with another embodiment of the present invention.

With continued reference to FIG. 4A, collar 99 is defined by two lip halves 100, 102 that are joined via diametrically opposed clamps 104. Each clamp 104 includes a pair of opposed blocks 106*a*, 106*b* extending from lip halves 100, 102. A threaded bore 107 extends through each block 106*a*, 106*b* and is configured to receive a bolt 108 or similar connector to thereby secure each pair of confronting blocks 106*a*, 106*b* against one another. When the two lip halves 100, 102 are wrapped about an end portion of a tube 16 (not shown) and the two pairs of blocks 106*a*, 106*b* are fastened via bolts 108, the collar 99 lockingly engages the tube 16.

Figure 5:
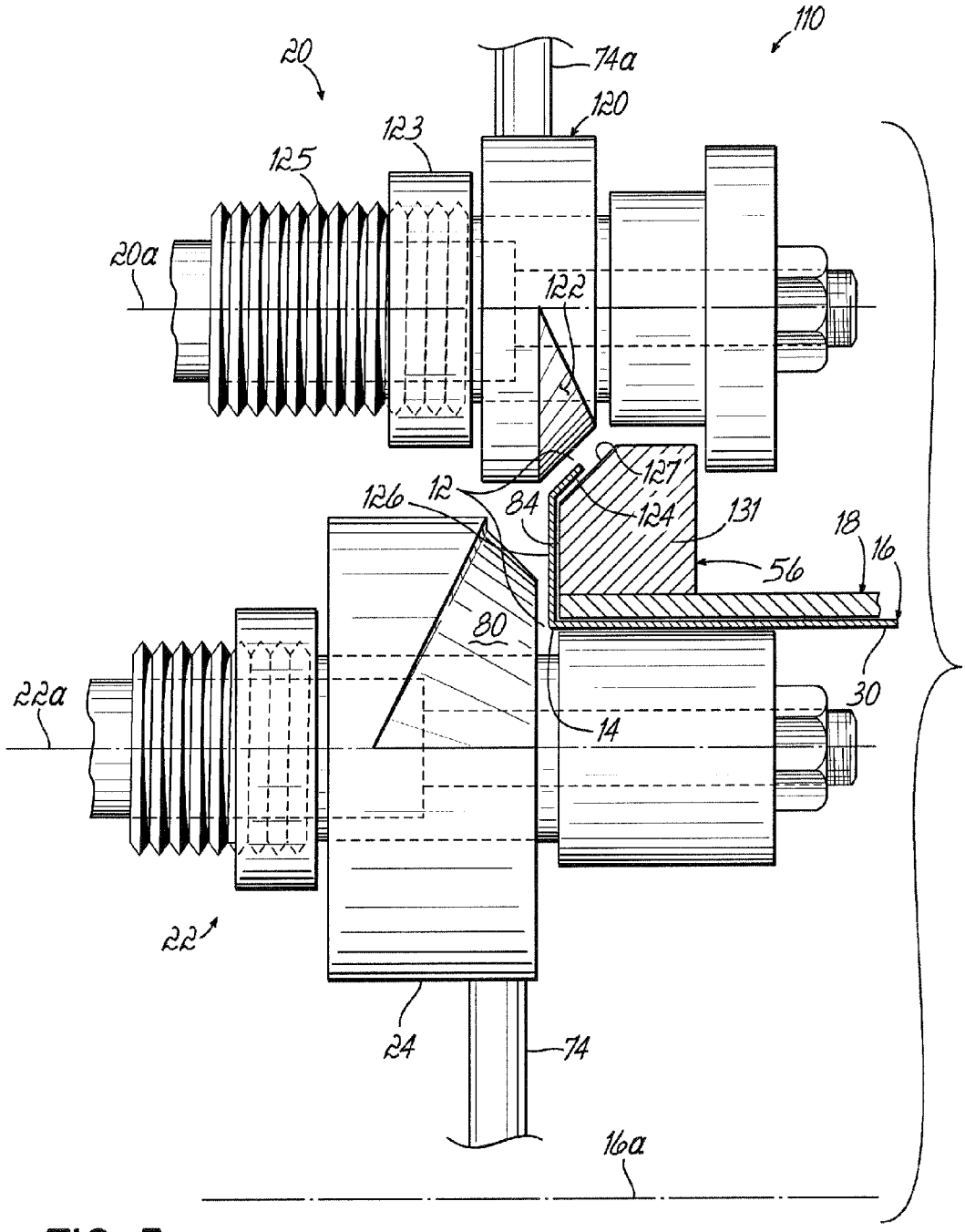
FIG. 5 is an elevational, partial cross-sectional view of a flange-forming system according to another embodiment of the present invention.

With reference to FIG. 5, in which like reference numerals refer to like features of FIGS. 1-4, another embodiment of a system 110 is configured for forming a flange 12 at an end 14 of a tube 16. System 110 includes components similar in most respects to those of system 10 (FIGS. 1-4), the description of which may be referred to for an understanding of system 110 as well.

System 110 includes a second rotatable cam 120 disposed about first roller 20 and rotatable about axis 20*a* of the first roller 20. The position of second rotatable cam 120 along axis 22*a* is determined by the position of a second adjustment collar 123 threadably engaged with a threaded portion 125 of first roller 20. In this regard, second adjustment collar 123 prevents movement of the second rotatable cam 120 away from the tube 16. Moreover, rotation of second rotatable cam 120 is facilitated by a handle 74*a* projecting therefrom and similar to handle 74. Second rotatable cam 120 includes a second cam surface 122 oriented such that rotation of second rotatable cam 120 advances second cam surface 122 in a direction along axis 20*a*. More particularly, the second cam surface 122 can be advanced against a distal portion 124 at end 14 of tube 16 to further define the flange 12. In this regard, advancement of second cam surface 122 bends the distal portion 124 in a direction transverse to a first leg or portion 126 of the flange 12. Advancement of the second cam surface 122 to bend distal portion 124 may be limited by a second limiting surface 127 of collar 18.

With further reference to FIG. 5, and by way of example, the second limiting surface 127 may be connected to or be integrally formed with lip 56 of collar 18 (as shown in FIG. 5). Moreover, second limiting surface 127 is oriented such that it defines an acute angle relative to end face 84, thereby permitting formation of a flange 12 having a distal leg or portion 124 oriented at an acute angle relative to first leg or portion 126 of the flange 12. Alternatively, the second limiting surface 127 may be coupled to or be integrally formed with another suitably chosen structure and/or be oriented at any angle relative to end face 84. Alternatively also, system 110 may include no second limiting surface 127 at all.

Figure 6:
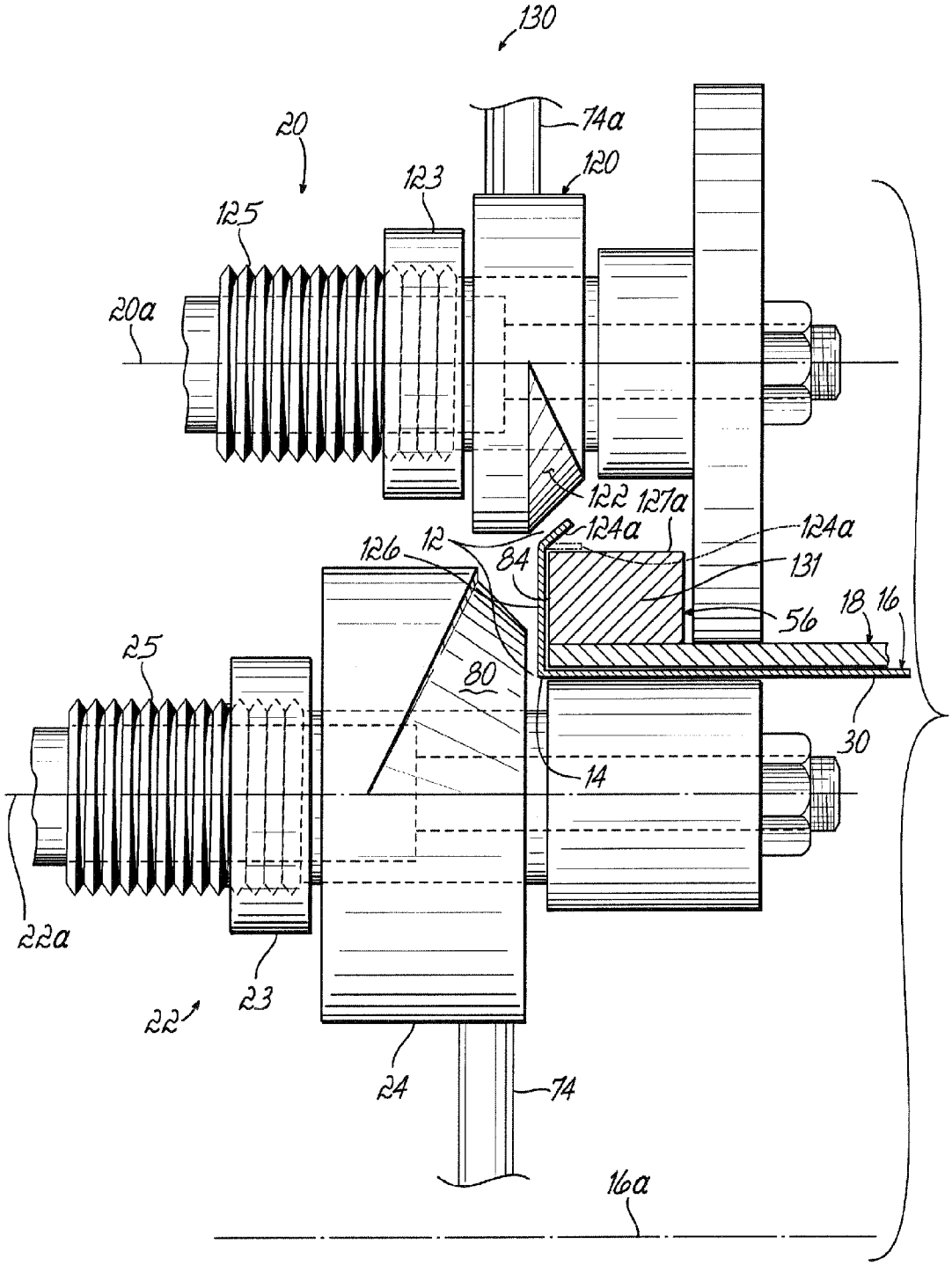
FIG. 6 is an elevational, partial cross-sectional view of a flange-forming system according to another embodiment of the present invention.

With reference to FIG. 6, in which like reference numerals refer to like features of the embodiment of FIG. 5, another embodiment of a flange-forming system 130 is illustrated, that is similar in most respects to system 110 of FIG. 5. In this regard, the description of system 110 may be referred to for an understanding of system 130 as well. System 130 includes a flange support structure 131 defining a second limiting surface 127*a* that is oriented generally orthogonal to end face 84 of lip 56. Accordingly, system 130 is capable of forming a flange 12 having first and second legs or portions 126, 124*a* that are generally orthogonal to one another. In this regard, FIG. 6 shows a first position of second leg portion 124*a* in solid lines and a subsequent position in phantom.

Figure 7:
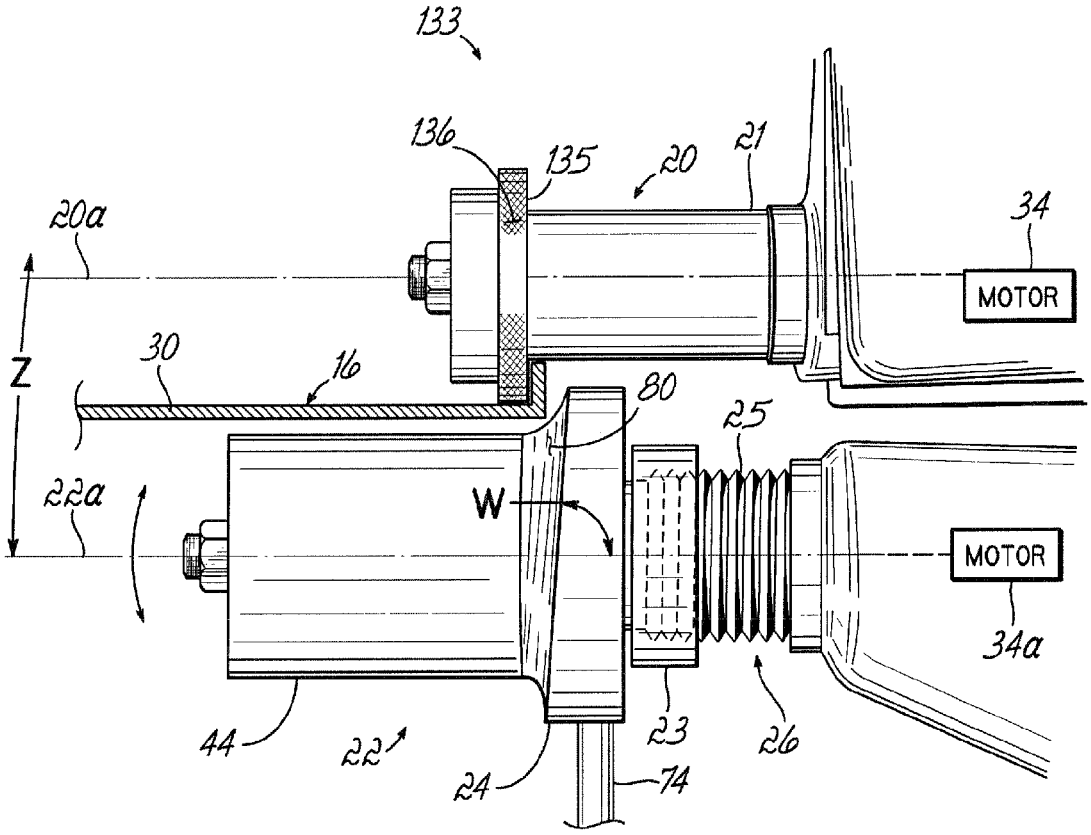
FIG. 7 is an elevational view of a flange-forming system according to another embodiment of the present invention.

With reference to FIG. 7, in which like reference numerals refer to like features in FIGS. 1-2, another embodiment of a flange-forming system 133 is illustrated, that is similar in most respects to system 10 of FIGS. 1-2, but unlike system 10, includes no collar at all. A wheel 135 is disposed on a first roller 20 of the system and is configured to frictionally drive the tube 16. In this regard, the wheel 135 may have a textured surface 136, as shown, or a surface otherwise configured to frictionally rotate tube 16 by engaging wall 30 thereof. Other aspects of the flange-forming process enabled by system 133 are similar to those of system 10 (FIGS. 1-2), the description of which may be referred to for an understanding of the process enabled by system 133 as well.

Figure 8:
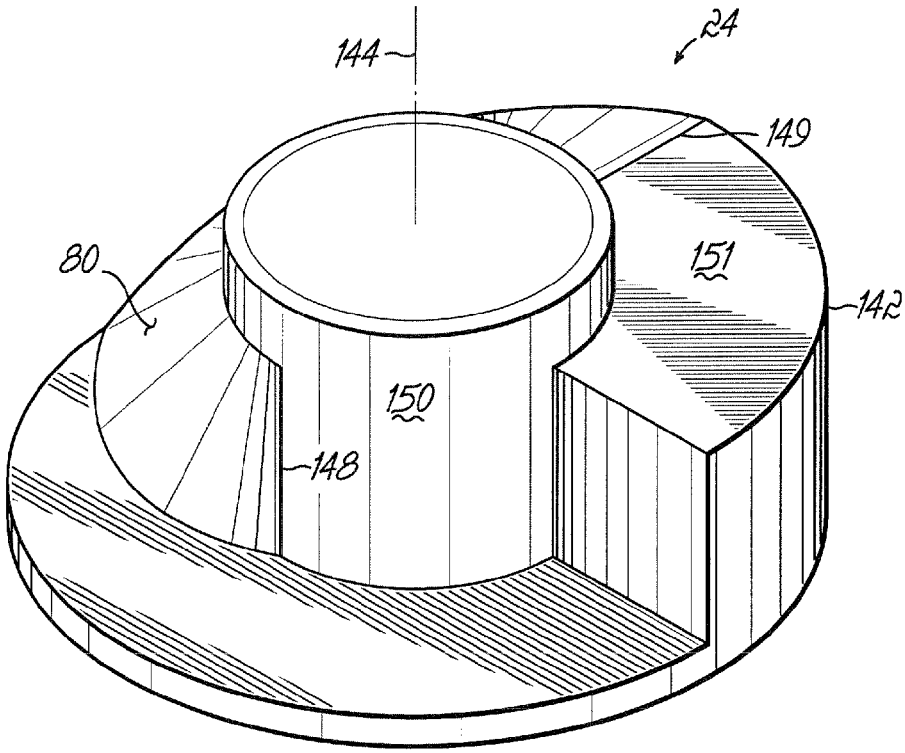
FIG. 8 is a perspective view of a rotatable cam in accordance with the principles of the present invention.
Figure 9:
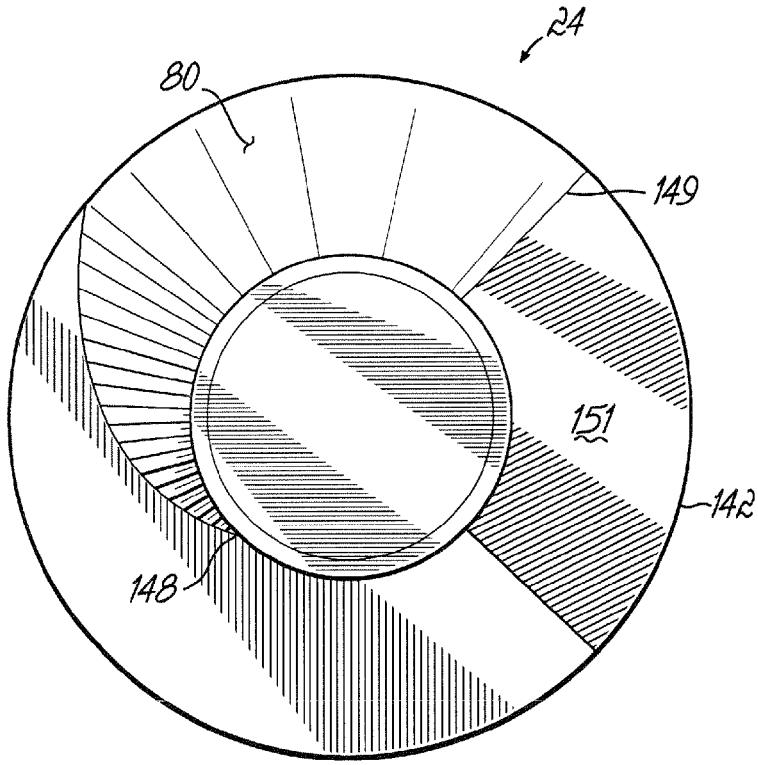
FIG. 9 is a planar view of the rotatable cam of FIG. 8.

With reference to FIGS. 8-11, exemplary configurations of each of the first and second rotatable cams 24, 120 are respectively depicted. With particular reference to FIGS. 8-9, the rotatable cam 24 is a generally cylindrical structure defining an outer circumferential perimeter 142 disposed about a main axis 144. In this regard, the rotatable cam 24 rotates about main axis 144 to cause the cam surface 80 thereof to advance against a tube, as explained above in regards to the embodiment of FIGS. 1-2. Cam surface 80 extends circumferentially about and axially along main axis 144, between a first edge 148 and a second edge 149.

First edge 148 lies generally on a cylindrical surface 150 of the rotatable cam 24, being therefore generally parallel to the main axis 144. By contrast, second edge 149 is oriented substantially orthogonal to the main axis 144, lying on a distal surface 151 of the rotatable cam 24, and is therefore oriented orthogonal to the first edge 148. The cam surface 80, accordingly, gradually and smoothly transitions from a first orientation at first edge 148, to a second orientation at second edge 149. This gradual transition provides for smooth, outward bending of the end portion 14 of tube 16, to thereby form the flange 12 (in the embodiment of FIGS. 1-2) or at least a first leg or portion 126 thereof (in the embodiment of FIG. 5). Cam surface 80 further extends radially to the outer perimeter 142 of the rotatable cam 24. In operation, the radial extension of cam surface 80 defines the length of the flange 12 (FIG. 1) or at least that of the first leg or portion 126 thereof (FIG. 5).

Figure 10:
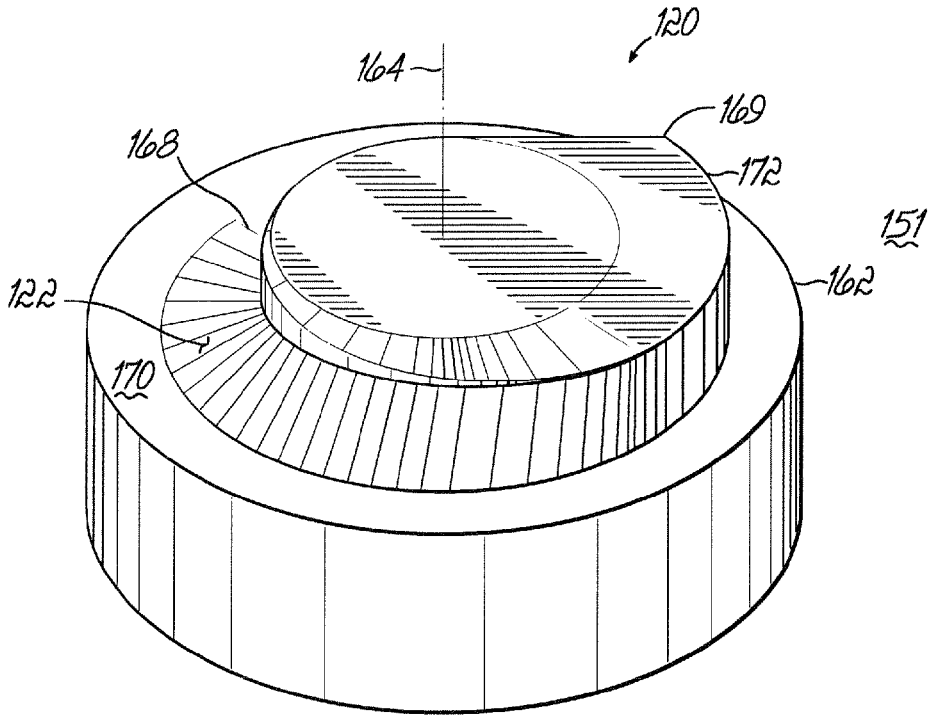
FIG. 10 is a perspective view of a rotatable cam in accordance with the principles of the present invention.
Figure 11:
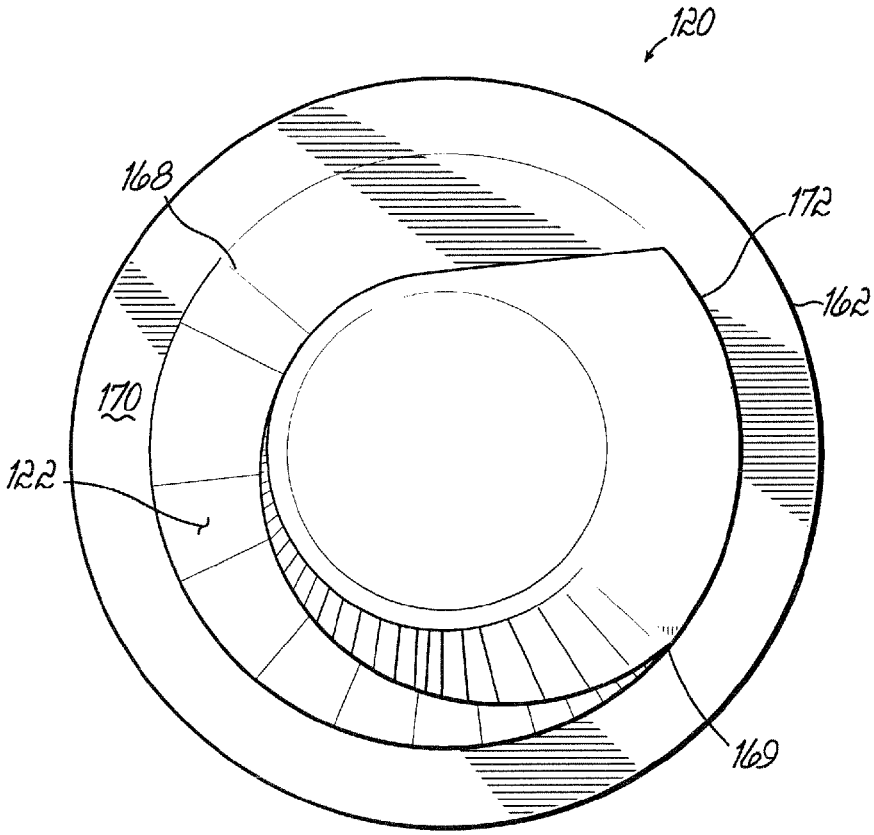
FIG. 11 is a planar view of the rotatable cam of FIG. 10.

With particular reference to FIGS. 10-11, the rotatable cam 120 is a generally cylindrical structure defining an outer circumferential perimeter 162 disposed about a main axis 164. In this regard, the rotatable cam 120 rotates about main axis 164 to cause cam surface 122 thereof to advance against a tube 16, as explained above in regards to the embodiment of FIGS. 5-6. Cam surface 122 extends circumferentially about and axially along main axis 164, between a first edge 168 and a second edge 169.

First edge 168 lies generally on a plane defined by a base surface 170 of the rotatable cam 120, being therefore generally orthogonal to the main axis 164. By contrast, second edge 169 is oriented generally substantially parallel to the main axis 164 and therefore orthogonal to the first edge 168. The cam surface 122, accordingly, gradually and smoothly transitions from a first orientation at first edge 168, to a second orientation at second edge 169. This gradual transition provides for smooth, outward bending of distal portion 124 of tube 14, to thereby form the second leg or portion 124, 124*a* of flange 12 (FIGS. 5-6). Cam surface 122 further extends radially to define an inner perimeter 172, lying within the area defined by outer perimeter 162. In this regard, therefore, cam surface 122 does not extend to the outer perimeter 162. In operation, the radial extension of cam surface 122 defines the length of the second leg or portion 124,124*a* of formed flange 12.

Figure 12A:
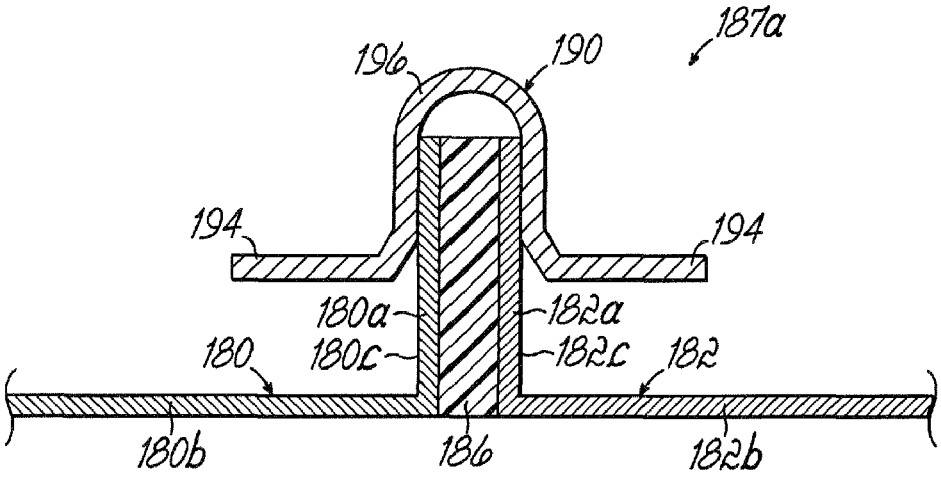
FIGS. 12A-12O are cross-sectional views of different embodiments of juncture assemblies according to the principles of the present invention.
Figure 12B:
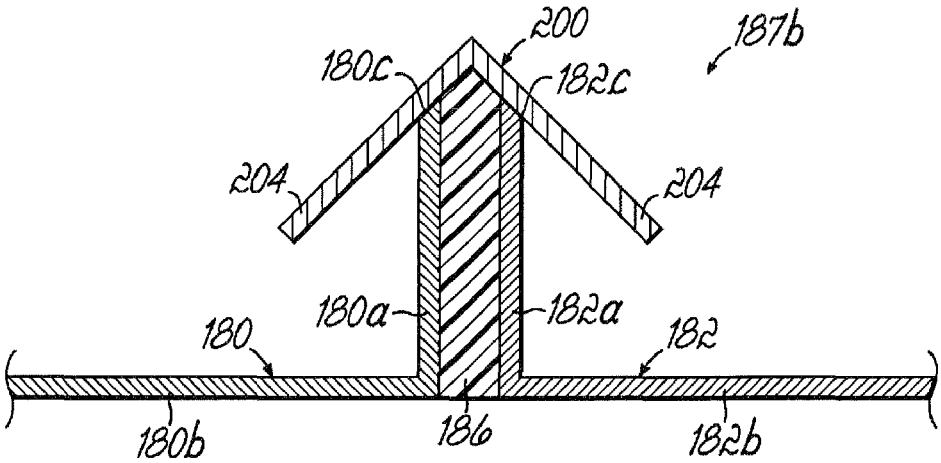
Figure 12C:
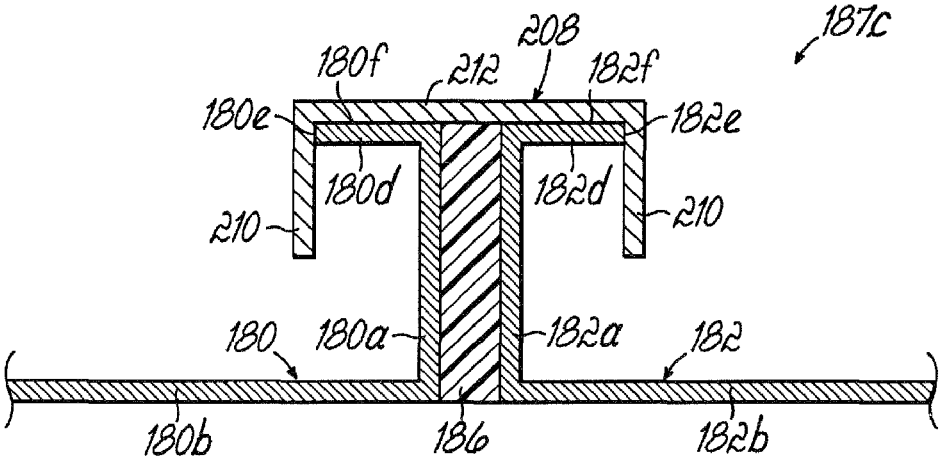
Figure 12D:
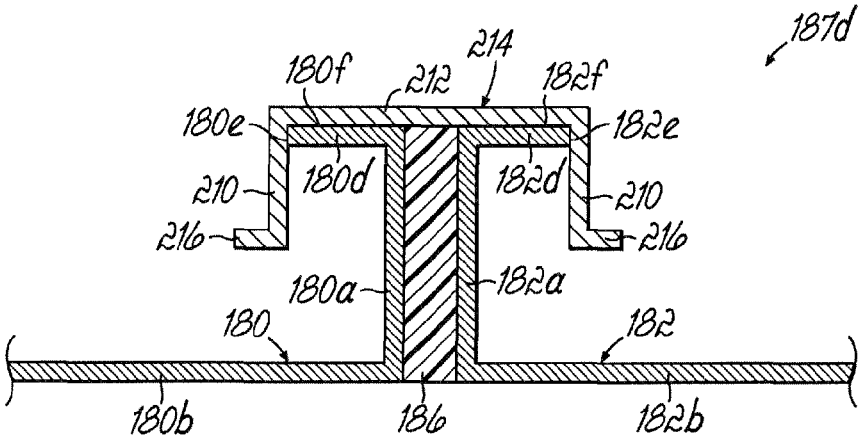
Figure 12E:
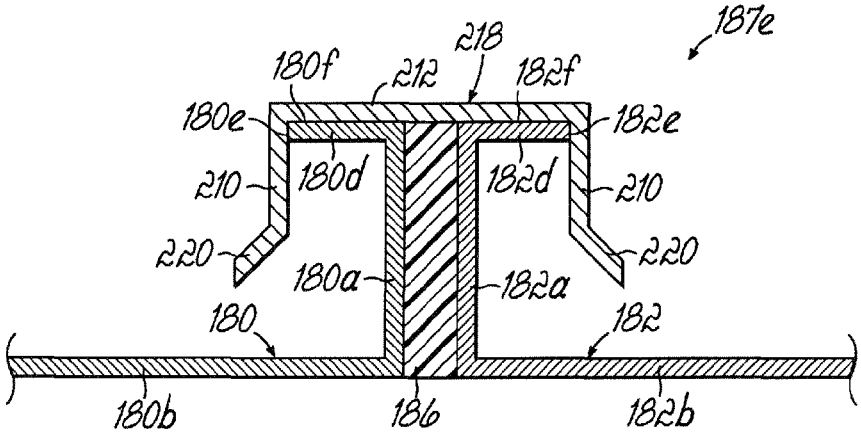
Figure 12F:
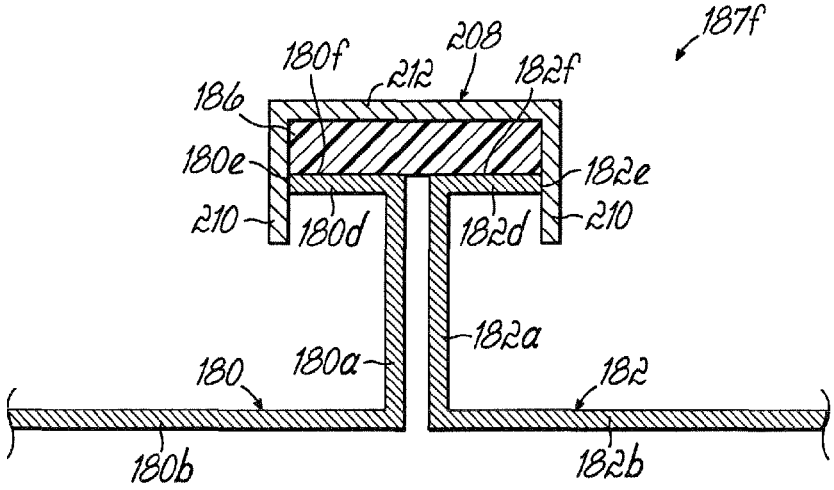
Figure 12G:
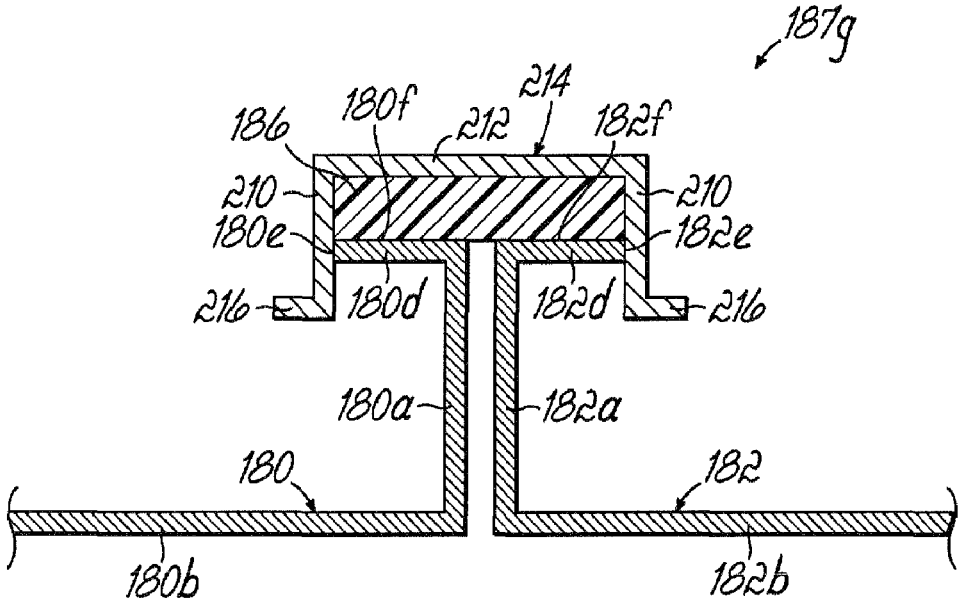
Figure 12H:
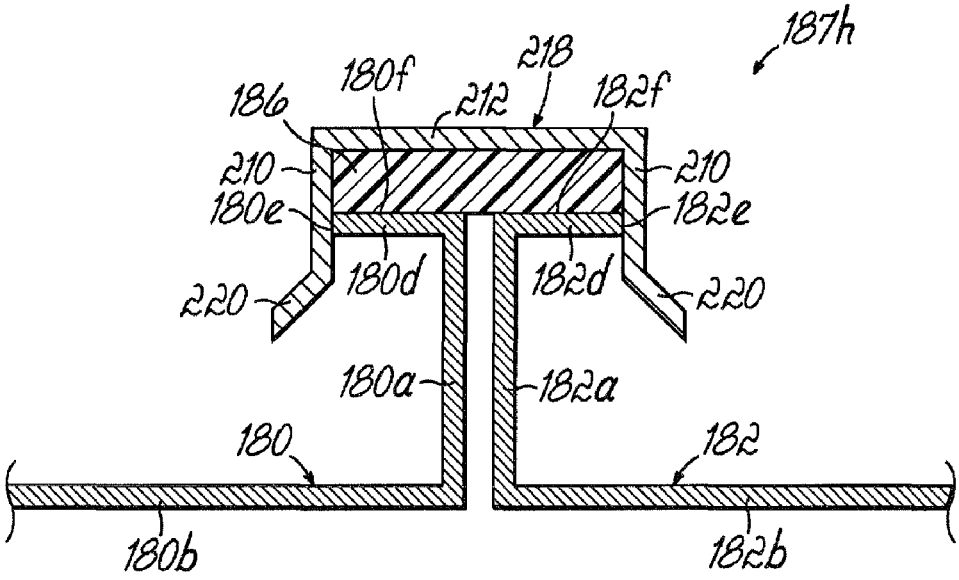
Figure 12I:
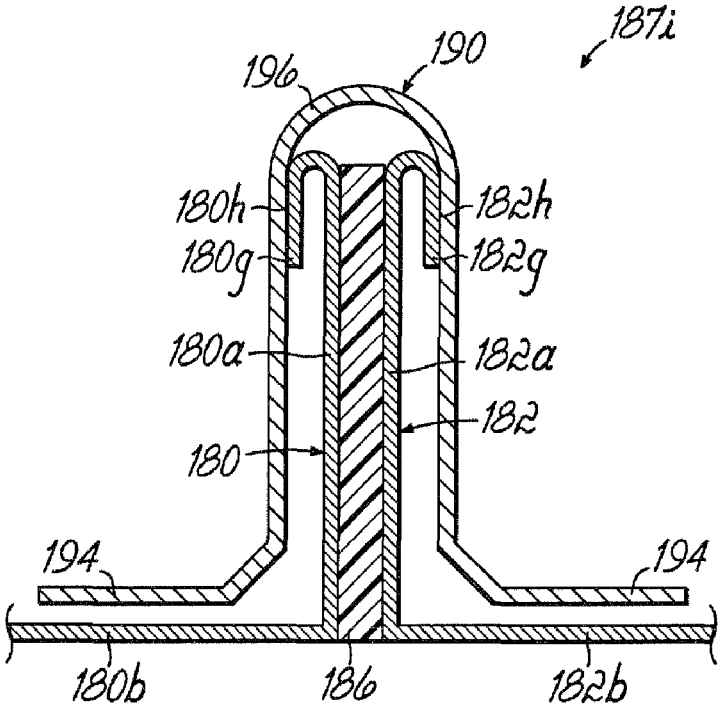
Figure 12J:
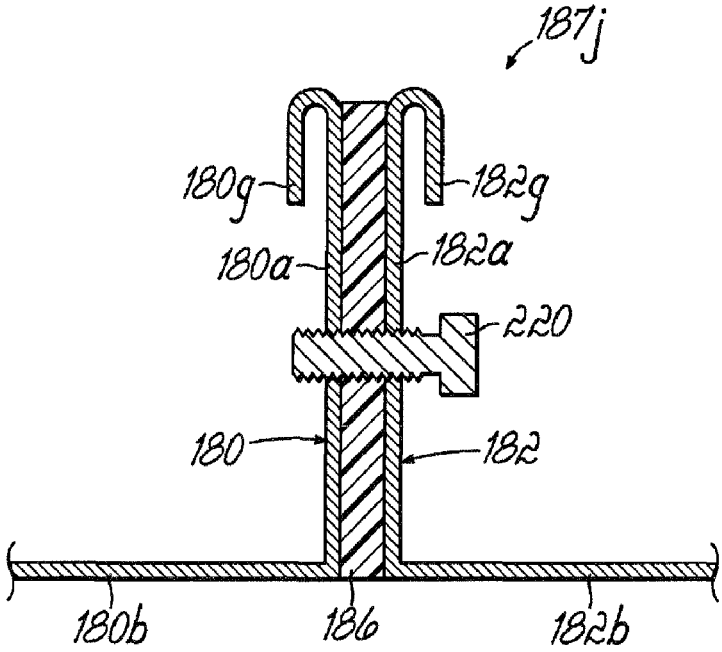
Figure 12K:
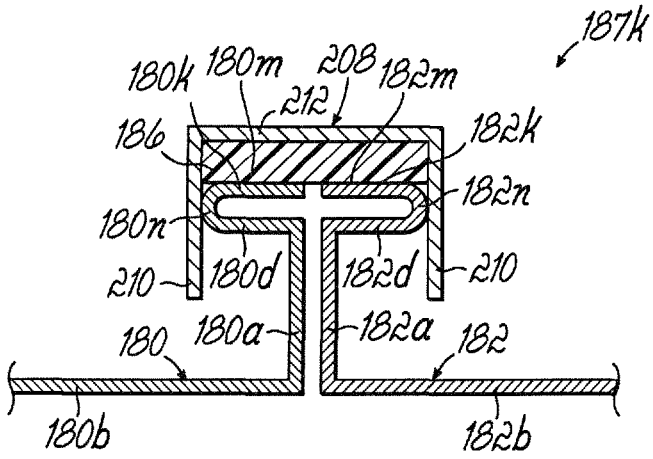
Figure 12L:
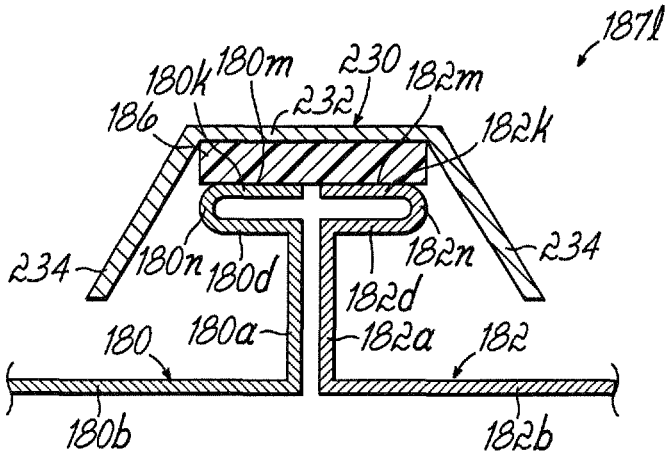
Figure 12M:
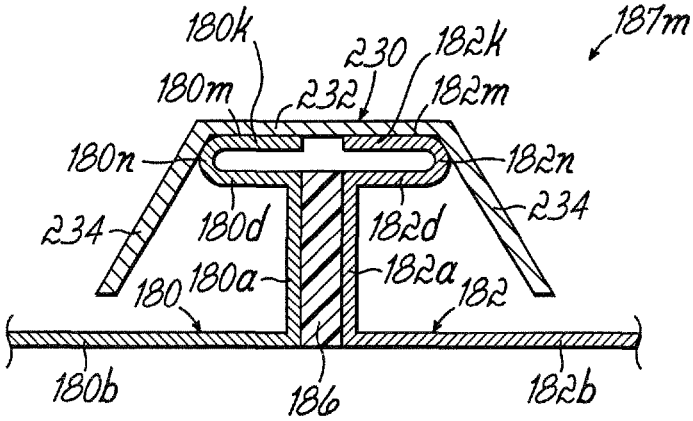
Figure 12N:
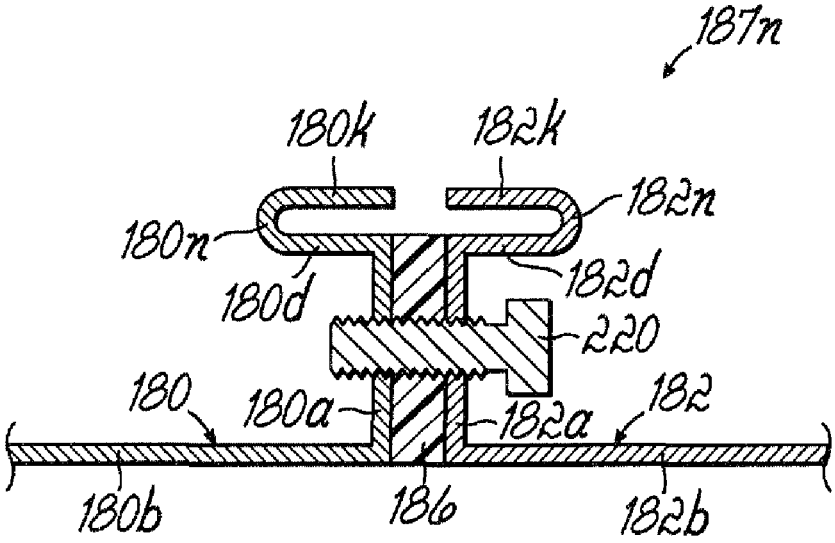
Figure 12O:
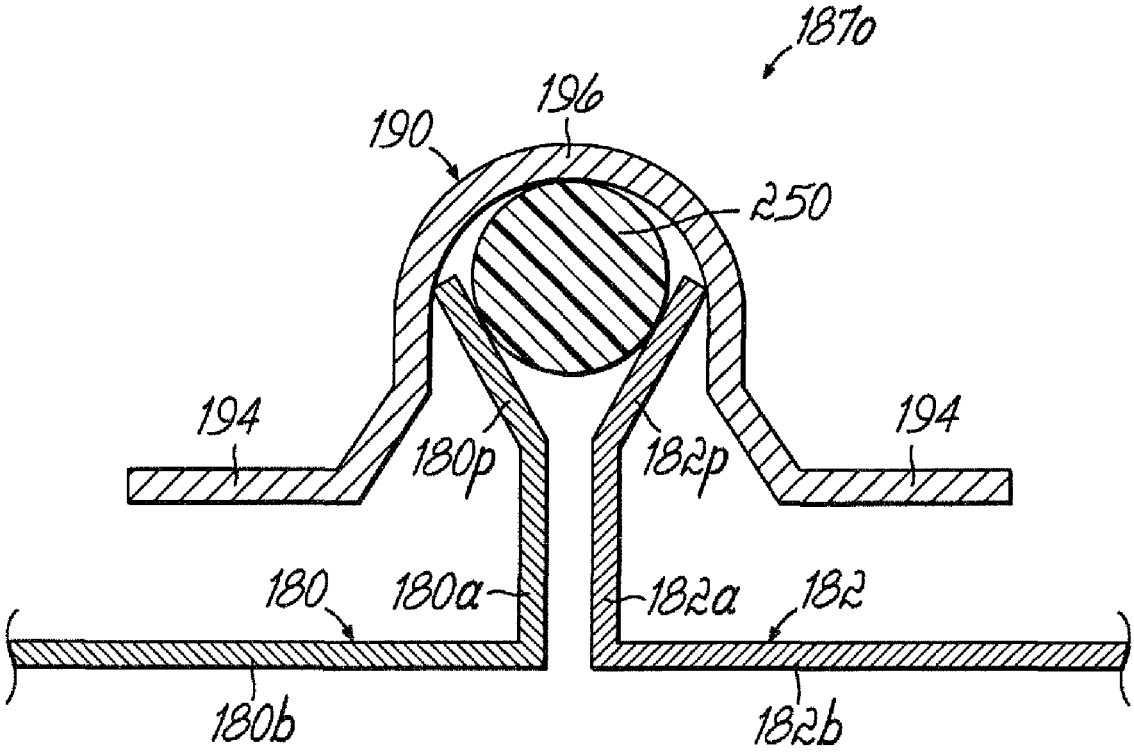

With reference to FIGS. 12A-12O, different embodiments of flange juncture assemblies are depicted, some of the features of which are facilitated by the systems described above. For ease of understanding, like features in these embodiments have like numerals.

With reference to FIGS. 12A and 12B, first and second flanges 180, 182 are positioned in a confronting relationship such that they may be joined with one another. Each of the first and second flanges 180, 182 is defined by a single leg 180*a*, 182*a* extending generally orthogonal to a main tube wall 180*b*, 182*b*. The juncture assembly includes a gasket member 186 disposed in a gap defined between legs 180*a*, 182*a*. Gasket member 186 has a generally rectangular cross-section, such as, for example and without limitation, rectangular. The cross-sectional shape of the gasket member 186 is suitably chosen such that it includes flat surfaces facing each of the legs 180*a*, 182*a*. Accordingly, gasket member 186 is configured to prevent travel of fluids through the gap between legs 180*a*, 182*a*. For example, and without limitation, gasket member 186 prevents travel of liquids such as water and gases such as processed air, return air or particle-carrying air streams into and/or out of the ductwork of which the flanges 180, 182 form part.

With particular reference to FIG. 12A, a juncture assembly 187*a* includes a clamp member 190 disposed over flanges 180, 182, contacting and applying a compressive force against outer surfaces 180*c*, 182*c* thereof, to thereby couple flanges 180, 182 to one another. Clamp member 190 is defined by clamp legs 194 extending generally parallel to main tube walls 180*b*, 182*b*, and a loop portion 196 formed between and joining clamp legs 194. Clamp member 190, and more particularly loop portion 196 thereof, prevents travel of fluid through the gap between first legs 180*a*, 182*a* and through or around gasket member 186.

With particular reference to FIG. 12B, a juncture assembly 187*b* includes a generally V-shaped clamp member 200 disposed over flanges 180, 182, contacting and applying a compressive force against outer surfaces 180*c*, 182*c* thereof, to thereby couple flanges 180,182 to one another. Clamp member 200 is defined by clamp legs 204 extending so as to define an acute angle relative to main tube walls 180*b*, 182*b*. Clamp member 200 prevents travel of fluid through the gap between first legs 180*a*, 182*a* and through or around gasket member 186.

With particular reference to FIGS. 12C-12H, each of the embodiments shown therein includes, in addition to first legs 180*a*, 182*a*, a pair of second legs 180*d*, 182*d* respectively extending from each of the first legs 180*a*, 182*a*. In these illustrative embodiments, each of the second legs 180*d*, 182*d* is oriented substantially orthogonal to respective first legs 180*a*, 182*a*. This is, however, not intended to be limiting, as second legs 180*d*, 182*d* may alternatively be oriented to define an acute or obtuse angle relative to first legs 180*a*, 182*a*.

With particular reference to FIG. 12C, a juncture assembly 187*c* includes a generally C-shaped clamp member 208 defined by opposed legs 210 and a center portion 212. Clamp member 208 is disposed over flanges 180, 182, contacting and applying a compressive force against ends 180*e*, 182*e* of second legs 180*d*, 182*d*, thereby coupling flanges 180, 182 to one another. Clamp member 208 also contacts outermost surfaces 180*f*, 182*f* of second legs 180*d*, 182*d*. Clamp member 208, and more particularly center portion 212 thereof, prevents travel of fluids through the gap between first legs 180*a*, 182*a* and through or around gasket member 186.

With particular reference to FIG. 12D, a juncture assembly 187*d* is similar to juncture assembly 187*c* (FIG. 12C) and includes a clamp member 214 similar to clamp member 208 but further including end portions 216 extending from legs 210 and oriented generally parallel to main tube walls 180*b*, 182*b*.

With particular reference to FIG. 12E, a juncture assembly 187*e* is similar to juncture assembly 187*d* (FIG. 12D) and includes a clamp member 218 similar to clamp member 214 but further including end portions 220 that are oriented such as to define an acute angle relative to main tube walls 180*b*, 182*b*.

With particular reference to FIG. 12F, a juncture assembly 187*f* has components that are similar to those of juncture assembly 187*c* (FIG. 12C) but where the gasket member 186 is disposed over outermost surfaces 180*f*, 182*f* of second legs 180*d*, 182*d*. In this regard, accordingly, clamp member 208 contacts only ends 180*e*, 182*e*, applying a compressive force against them to thereby couple flanges 180, 182 to one another.

With particular reference to FIG. 12G, a juncture assembly 187*g* combines aspects of the embodiments of FIGS. 12D and 12F. More particularly, juncture assembly 187*g* includes the general structure of juncture assembly 187*f* (FIG. 12F) and the clamp member 214 of juncture assembly 187*d* (FIG. 12D). Accordingly, the structure and function of juncture assemblies 187*d*, 187*f* may be referred to for an understanding of juncture assembly 187*g* as well.

With particular reference to FIG. 12H, a juncture assembly 187*h* combines aspects of the embodiments of FIGS. 12E and 12F. More particularly, juncture assembly 187*h* includes the general structure of juncture assembly 187*f* (FIG. 12F) and the clamp member 218 of juncture assembly 187*e* (FIG. 12E). Accordingly, the structure and function of juncture assemblies 187*e*, 187*f* may be referred to for an understanding of juncture assembly 187*h* as well.

With particular reference to FIGS. 12I-12J, each of the embodiments shown therein includes, in addition to first legs 180*a*, 182*a*, a pair of second legs 180*g*, 182*g* respectively extending from each of the first legs 180*a*, 182*a* but oriented so as to define an angle of about 180° relative to each of the first legs 180*a*, 182*a*. The junction between each of the first legs 180*a*, 182*a* and each of the second legs 180*g*, 182*g* is depicted as a loop, although this is not intended to be limiting but rather merely exemplary.

With particular reference to FIG. 12I, a juncture assembly 187*i* includes a clamp member 190 similar in structure and function to that of FIG. 12A. Clamp member 190 contacts and applies a compressive force against outer surfaces 180*h*, 182*h* of second legs 180*g*, 182*g*, thereby coupling flanges 180,182 to one another.

With particular reference to FIG. 12J, a juncture assembly 187*j* is similar in structure to juncture assembly 187*i* (FIG. 12I) but includes no clamp member at all. Instead, a connector or fastener, such as a bolt 220 couples flanges 180 and 182 to one another, thereby also mechanically fastening gasket member 186 to first legs 180*a*, 182*a*.

With particular reference to FIGS. 12K-12N, each of the embodiments shown therein includes, in addition to first legs 180*a*, 182*a* and second legs 180*d*, 182*d*, a pair of third legs 180*k*, 182*k* respectively extending from each of the second legs 180*d*, 182*d* and oriented generally transverse (e.g., orthogonal) to first legs 180*a*, 182*a*. The junction between each of the second legs 180*d*, 182*d* and each of the third legs 180*k*, 182*k* is depicted as a loop 180*n*, 182*n*, although this is not intended to be limiting but rather merely illustrative.

With particular reference to FIG. 12K, a juncture assembly 187*k* includes a gasket member 186 disposed over outer surfaces 180*m*, 182*m* of third legs 180*k*, 182*k*, as shown. A C-shaped clamp member 208 is disposed over gasket member 186 and applies a compressive force against loops 180*n*, 182*n*, thereby coupling flanges 180 and 182 to one another.

With particular reference to FIG. 12L, a juncture assembly 187*l* is similar to juncture assembly 187*k* (FIG. 12K) but includes a clamp member 230 having a central portion 232 and two opposed legs 234, each defining an acute angle relative to central portion 232.

With particular reference to FIG. 12M, a juncture assembly 187*m* combines the clamp member 230 of juncture assembly 187*l* (FIG. 12L) with a flange structure including a gasket member 186 placed between the first legs 180*a*, 182*a* similarly in this regard, for example, to the embodiment of FIG. 12A.

With particular reference to FIG. 12N, a juncture assembly 187*n* is similar to juncture assembly 187*m* (FIG. 12M) but includes no clamp member at all. Instead, a connector or fastener, such as a bolt 220 couples flanges 180 and 182 to one another, thereby also mechanically fastening gasket member 186 to first legs 180*a*, 182*a*.

With particular reference to FIG. 12O, a juncture assembly 187*o* includes, in addition to first legs 180*a*, 182*a*, a pair of second legs 180*p*, 182*p* respectively extending from each of the first legs 180*a*, 182*a* and oriented so as to define an acute angle relative to each of the first legs 180*a*, 182*a*. Moreover, an angle between second legs 180*p*, 182*p* defines a recess configured to accept a gasket member 250 having a cross-section other than one including flat surfaces (e.g., gasket member 86 of FIGS. 12A-12N). In this exemplary embodiment, for example, gasket member 250 is depicted having a circular cross-section, although this is not intended to be limiting. A clamp member 190 is disposed to contact and apply compressive forces against gasket member 250, as well as second legs 180*p*, 182*p*, thereby coupling flanges 180, 182 to one another.

With continued reference to FIG. 12O, and similarly to the embodiments of FIGS. 12A-12M, the clamp member 190 and the position of gasket member 250 jointly prevent travel of fluids through the gap between first legs 180*a*, 182*a* and through or around gasket member 250.

It should be readily appreciated that although certain embodiments and configurations of the invention are shown and described herein, the invention is not so limited. Moreover, any of the features and/or functions described above for any of the above embodiments may be combined with any other embodiments.

From the above disclosure of the general principles of the present invention and the preceding detailed description of exemplary embodiments, those skilled in the art will readily comprehend the various modifications to which this invention is susceptible. For example, while a spiral tube is depicted herein for illustrative purposes, other types of tubes are contemplated. Therefore, this invention is intended to be limited only by the scope of the following claims and equivalents thereof.

What is claimed is:

1. A method of forming a flange at an end of a tube comprising:

engaging the tube with a collar surrounding an outer surface of the tube;

engaging the collar with a first roller;

engaging the collar with a second roller having an axis of rotation and cooperating with the first roller to rotate the collar and the tube; and rotating a first cam about the axis of rotation to advance a cam surface of the first cam against the end of the tube to thereby form the flange, the first cam being rotatable about the axis of rotation independently of the second roller.

2. The method of claim 1, wherein engaging the tube with the collar includes restricting movement of the tube relative to the collar.

3. The method of claim 1, wherein engaging the tube with the collar further comprises receiving a seam disposed on a wall of the tube within a channel of the collar.

4. The method of claim 1, further comprising:

bending the end of the tube in a first direction; and advancing a second cam against a distal portion of the end of the tube to thereby bend the distal portion in a second direction transverse to the first direction.

5. A system for forming a flange at an end of a tube comprising:

a collar configured to surround the tube;

a first roller engaging said collar;

a second roller configured to cooperate with said first roller to rotate said collar and the tube; and a rotatable cam rotatable independently of said second roller, said rotatable cam and said second roller being rotatable about a common axis of rotation, said rotatable cam including a cam surface configured to bend the end of the tube to thereby form the flange.

6. The system of claim 1, wherein said collar is configured to restrict axial movement of the tube relative to said collar.

7. The system of claim 1, wherein said collar is configured to restrict rotational movement of the tube relative to said collar.

8. The system of claim 1, wherein said collar and said first roller respectively include first and second lips cooperating with one another to restrict axial movement of said collar relative to said first roller.

9. The system of claim 1, wherein said cam surface extends in a circumferential direction about said common axis of rotation.

10. The system of claim 9, wherein said cam surface is oriented on a plane defining an acute angle relative to said common axis of rotation.

11. The system of claim 9, wherein rotation of said rotatable cam about said common axis of rotation advances said cam surface axially toward the end of the tube to thereby form the flange.

12. The system of claim 1, further comprising a second rotatable cam, said cam surface being configured to bend the end of the tube in a first direction, said second rotatable cam including a second cam surface configured to bend a distal portion of the end of the tube in a second direction transverse to said first direction.

13. The system of claim 1, wherein said collar includes a channel configured to receive a seam of the tube therein.

14. The system of claim 13, wherein said channel is configured to receive a helically directed seam of the tube therein, the helically directed seam being oriented at an acute angle relative to a longitudinal axis of the tube.

15. The system of claim 1, wherein said collar includes at least one clamp configured to move said collar into locking engagement with the tube.

16. The system of claim 1, further comprising:

at least one motor operatively coupled to one of said first or second rollers and configured to rotate said one of said first and second rollers.

17. The system of claim 1, wherein said collar includes at least one fastening block for securing said collar relative to the tube.

18. A system for forming a flange at an end of a tube comprising:

a first roller configured to engage the tube;

a second roller configured to cooperate with said first roller to rotate the tube; and a rotatable cam rotatable independently of said second roller, said rotatable cam and said second roller being rotatable about a common axis of rotation, said cam including a cam surface configured to bend the end of the tube to thereby form the flange.

19. A system for forming a flange at an end of a tube comprising:

a collar configured to surround the tube;

a first roller engaging said collar;

a second roller configured to cooperate with said first roller to rotate said collar and the tube;

a rotatable cam disposed about said second roller and rotatable independently of said second roller, said rotatable cam including a cam surface configured to bend the end of the tube to thereby form the flange;

a second rotatable cam, said cam surface being configured to bend the end of the tube in a first direction, said second rotatable cam including a second cam surface configured to bend a distal portion of the end of the tube in a second direction transverse to said first direction; and a stopping surface associated with said collar for restricting bending of the distal portion of the end of the tube in the second direction.

20. The system of claim 19, wherein said stopping surface is disposed at an acute angle relative to the first direction.

21. The system of claim 19, wherein said stopping surface is generally orthogonal to the first direction.

22. A system for forming a flange at an end of a tube comprising:

a collar configured to surround the tube;

a first roller engaging said collar;

a second roller configured to cooperate with said first roller to rotate said collar and the tube; and a rotatable cam disposed about said second roller and rotatable independently of said second roller, said rotatable cam including a cam surface configured to bend the end of the tube to thereby form the flange, wherein said rotatable cam includes a main axis, said cam surface extending circumferentially and axially between first and second edges of said cam, said first and second edges being transverse to one another.

23. The system of claim 22, wherein said second edge is substantially orthogonal to said main axis.

24. The system of claim 22, wherein said second edge is substantially parallel to said main axis.

* * * * *